United States Patent [19]

Kroner

[11] 4,183,433

[45] Jan. 15, 1980

[54] FOLDABLE CONTAINER WITH AT LEAST ONE RECEPTACLE FOR ELONGATED ARTICLES

[76] Inventor: Klaus Kroner, Ahornweg, Freudental, Fed. Rep. of Germany

[21] Appl. No.: 729,706

[22] Filed: Oct. 5, 1976

[30] Foreign Application Priority Data

Feb. 5, 1976 [DE] Fed. Rep. of Germany ..... 2604413

[51] Int. Cl.[2] ..... B65D 85/10

[52] U.S. Cl. ..... 206/257; 206/256; 206/261

[58] Field of Search ..... 206/250, 251, 256, 257, 206/261, 262, 268, 379, 443

[56] References Cited

U.S. PATENT DOCUMENTS

| | | | |
|---|---|---|---|
| 1,156,019 | 10/1915 | Nivois | 206/251 |
| 1,183,421 | 5/1916 | Allen | 206/251 |

FOREIGN PATENT DOCUMENTS

| | | | |
|---|---|---|---|
| 242079 | 8/1965 | Austria | 206/379 |
| 15743 | of 1912 | United Kingdom | 206/251 |
| 143799 | 6/1920 | United Kingdom | 206/251 |

*Primary Examiner*—Stephen Marcus

[57] ABSTRACT

A container for holding in an orderly assembly objects such as writing instruments, tools, cigarettes and other similar objects, has a pair of substantially identically shaped covers provided with opposed peripheral rims, a cover pivoting means adjacent each pair of opposing rims of said covers to mount the covers pivotally together onto a receptacle to form said container to fold or close and to unfold or open. The rims have a combined depth at least equal to the width of the receptacle to accommodate it in the closed position of the covers. The container has at least one pivotable receptacle for holding at least one of said objects, said receptacle having part of said pivoting means and a bottom surface adjoining said pivoting means, said receptacle being mounted between the rims of the said covers to said pivoting means. On opening the container the receptacle is automatically erected and exposed for ease of handling of the articles and visual inspection.

7 Claims, 12 Drawing Figures

CONTAINER 1
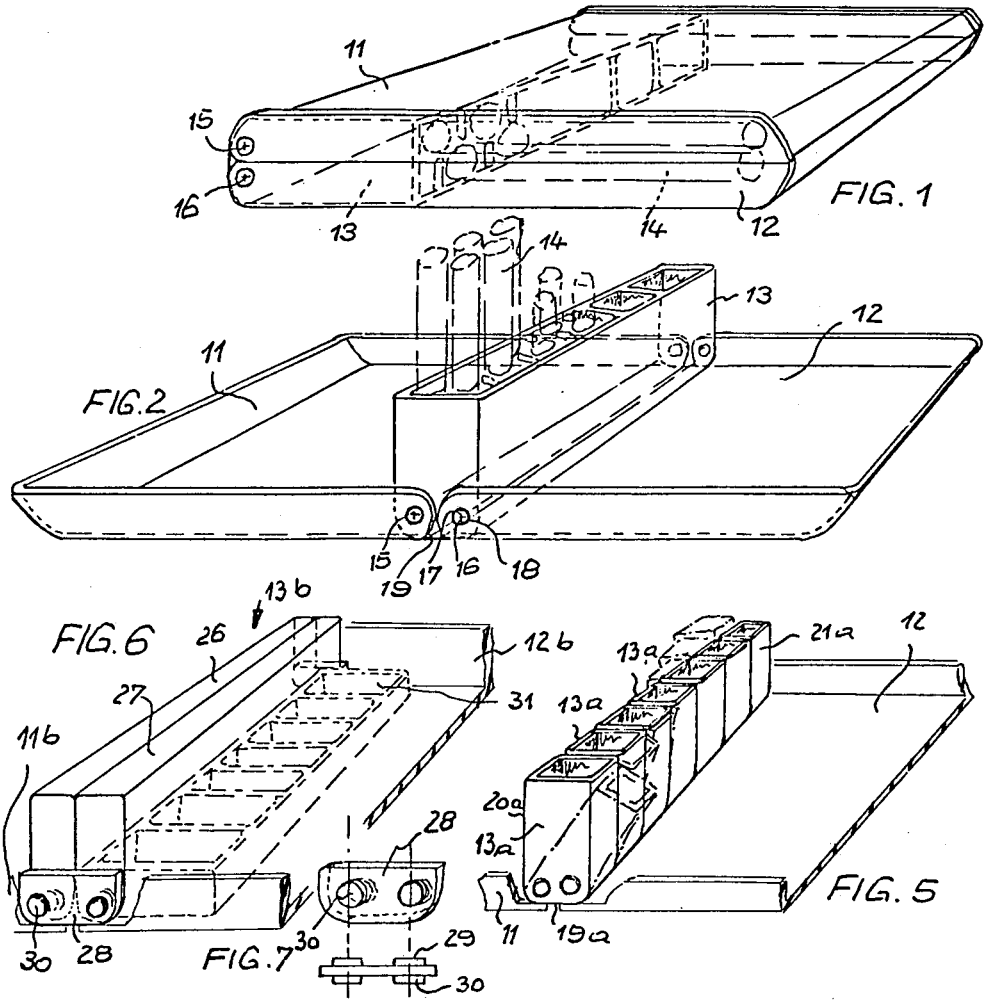
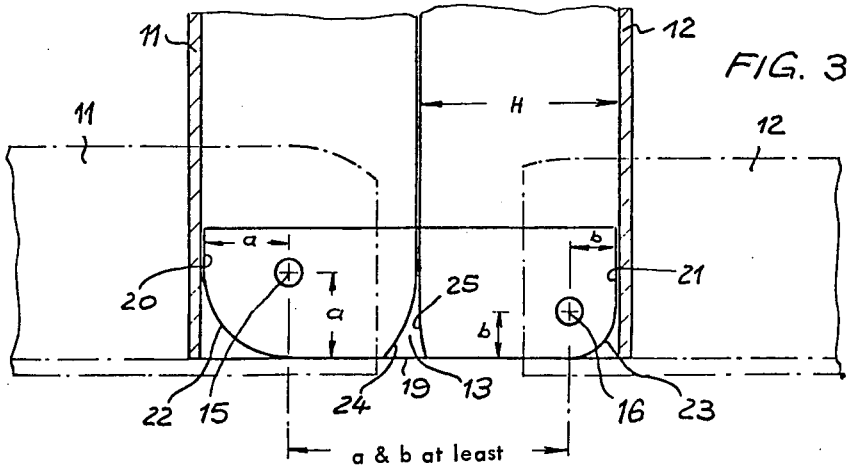

FOLDABLE CONTAINER WITH AT LEAST ONE RECEPTACLE FOR ELONGATED ARTICLES

CROSS-REFERENCE TO A PRIOR APPLICATION

Priority of German Application No. P 26 04 413, filed Feb. 5, 1976 is claimed under the convention.

FIELD OF THE INVENTION

The invention relates to a foldable container formed by two covers pivotable about bearing means, with at least one interior receptacle to be erected to a certain position, mounted pivotably to at least one of the covers, when the covers are unfolded.

DESCRIPTION OF THE PRIOR ART

U.S. Pat. No. 1,160,931, issued Nov. 16, 1915, for: Cigarette Box or Case, by A, Mendelson, and U.S. Pat. No. 1,685,276, issued Sept. 25, 1928, for: Receptacle, by F. H. Doerr, are made of record.

The Mendelson container consists of two covers foldably connected by means of a single hinge. Within each cover U-shaped elastic hoops are arranged which in turn are pivotable about bearings of their own. A complicated lever device puts the cigarette holders mounted on the hoops into the erect position. In Doerr two separate covers are separately pivoted to a container, for limited opening.

SUMMARY OF THE INVENTION

The objects of the invention are to provide:

A container of the type described wherein the arrangement and the connections of the covers and of the holding receptacles are designed in such a way that, notwithstanding a simple structure, consisting of a few parts, permits a convenient access to the articles stored in the receptacles as well as an unimpeded re-insertion thereof.

Bearings common to the covers and the holding receptacle or receptacles;

abutment surfaces on the bottom surface of each receptacle by which the covers in the open position are supported at their internal surfaces in such a way that each receptacle is positively adjusted in an angular position which corresponds approximately to one half of the aperture angle of the covers;

the receptacles for an orderly row-type alignment of elongated articles, such as of pencils or crayons, in an easy optically distinguishable manner and for an easy insertion and ready availability of the articles.

Other objects and many of the advantages of the invention will become obvious to those skilled in the art from the following description, drawings and claims.

BRIEF DESCRIPTION OF THE DRAWINGS

In the drawings the same reference numerals denote the same or equivalent parts and repetitions thereof are omitted for purposes of brevity.

FIG. 1 is a diagrammatic view of a container of the invention with one receptacle and with the covers closed.

FIG. 2 is a perspective view of the container or FIG. 1 in an open state.

FIG. 3 is a cross sectional view of FIG. 1 with representation of the dimensions between the individual essential structural parts of the container.

FIG. 5 is a perspective view of a receptacle of the container showing another improvement of the invention.

FIG. 6 is a perspective view of a further improvement on the receptacle of the invention.

FIG. 7 shows a spacer for the formation of the bearing between the covers and the receptacle according to FIG. 6.

DESCRIPTION OF THE PREFERRED EMBODIMENTS

Figure 4:
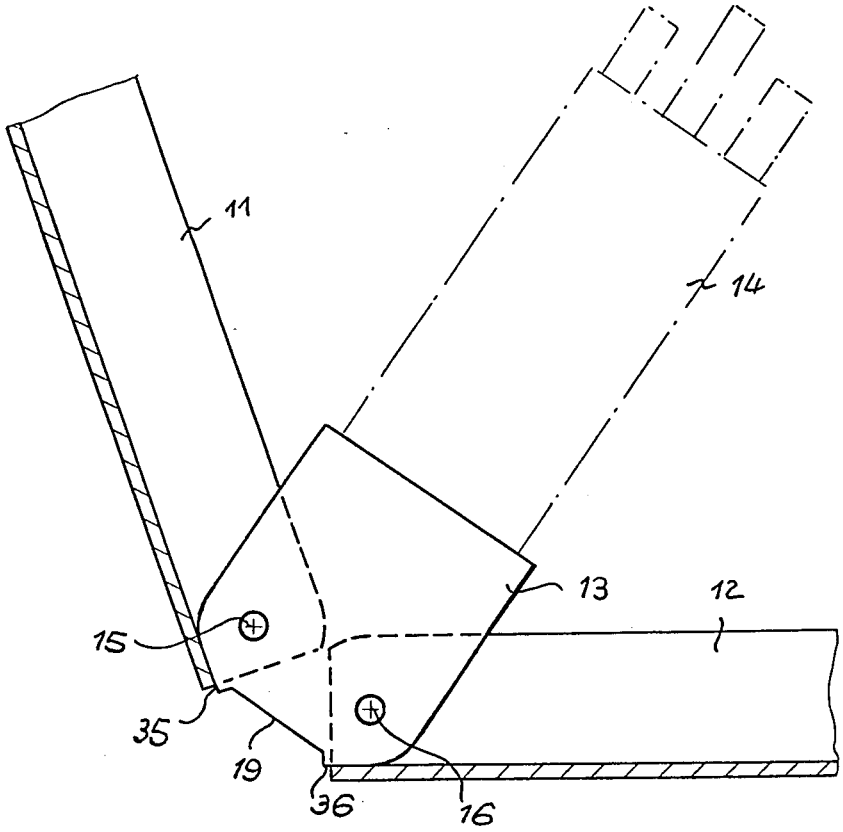
FIG. 4 is a cross sectional view showing an improvement, in the open state of the container.

The container of the invention is constructed in such a way that the distances of the bearing pins of the two covers from the bottom surface and the receptacle side wall associated with the respective cover are equal.

An additional improvement, however, is spacing the bearing pin of one cover from the bottom surface and the side wall of the container differently from the corresponding distances of the bearing pin of the other cover.

A further improvement of the invention provides the container with several receptacles which are positioned rotatably on each other, with the bearing pins for the covers provided on the outer receptacles, whereby the bottom surfaces of the individual receptacles have different inclinations with respect to the vertical, in such a way that the individual receptacles are in a fanlike position when the covers are unfolded by 180°. This arrangement aids a ready visual detection and insertion of the articles and improves their accessibility.

In a further improvement, the receptacle is divided in its longitudinal direction vertically into two receptacle sections, each section being provided with bearing pins and/or bores and with a spacer on each side of the receptacle, inserted between the receptacle sections and the rims of the covers, the spacer provided with complementary pins and/or bores for the support of both covers on the receptacle sections.

In a further improvement of the invention the container has two or more individual receptacles extending over its width. The individual receptacles are positively pivotable into an erect position when the container is opened by means of cams provided on the covers and the receptacles and associated with each other. For the flexible connection of the receptacles with the covers a spacer is provided on each side, by which the receptacles are supported in their erect position.

In this manner a substantially greater number of articles can be placed in one container without impairing the visible arrangement of the parts and the convenient access thereto.

The receptacles are provided with steps which are supported by associated support surfaces of each spacer. The surfaces on the spacers are arranged in such a way that when the container is opened several individual receptacles are erected into angular positions which corresponds to an equiangular subdivision of the entire aperture angle of the covers. In a further improvement the invention teaches the construction of the middle receptacle, when the three receptacles are provided, in one piece with the two spacers. For the formation of the joint between the receptacles and the covers an elastic expanding bushing is provided which passes through corresponding bearing bores of a cover, of the spacer, and of a receptacle, and with projections reaches behind a shoulder formed by a hollow space in the receptacle.

As shown on FIGS. 1 to 3, the container 1 is formed of two flat, boxlike covers 11 and 12 of about equal shape and size, which enclose a rectangular receptacle 13 for holding articles 14 such as pencils, crayons or other tools or cigarettes, napkins and similar articles.

The covers 11 and 12 are mounted foldably on the receptacle 13, each about its own pair of bearings 15 and 16, respectively, as shown in greater detail on FIG. 3. These bearings define first and second parallel, laterally-spaced pivot axes. For this purpose, pivot pins 17 are provided on the receptacle with mating bores 18 in the covers. The bearings as shown in FIG. 3 are located at the distance "a" of the bearing as shown from the bottom surface 19 of the receptacles which distance equals that from the side wall 20 of the receptacle 13. The same applies to the distance "b" of the bearing 16 from bottom surface 19 and the side wall 21. In this manner, the covers with their internal surfaces when the container is folded abut with play against the side walls of the receptacle, so that the latter, even when the container is folded, has a guide, and the container itself is stable and is prevented from more than a minimal angular play inside the folded cover sections.

When the container is open, as in FIG. 2, and the side walls of covers 11 and 12 are substantially coplanar, the internal surfaces of the covers are in contact with the bottom surface 19 of the receptacle and force or cam the latter into a vertical position when the covers lie open at an angle of 180° on a horizontal support. In the closed position of FIG. 1 the side walls of the covers are, as shown, superposed and essentially parallel.

Although the distances "a" and "b" of bearings 15 and 16 from bottom surface 19 and a sidewall 20 or 21 may be equal, the distance "a" of one of the bearings may be different from distance "b" of the other bearing, the bore 18 in each cover, however, must be adaptable to the position of its bearing pin 17.

In order to assure a fully satisfactory folding of the covers, the longitudinal edges 22 and 23 extending between the lateral surface of the side wall and the bottom surface 19 are rounded. The radii of the roundings correspond to distance "a" or "b," respectively, and have their center in the bearing 15 or 16.

Likewise the corners facing each other of the edges of the covers are rounded with curves 24 and 25, respectively. Their radii have their centers likewise in the bearings, the length of each radius equals the height "h" of the side wall of the respective cover less the associated distance "a" or "b" respectively. The curves, however, are required only when the narrow surfaces of the side walls are superposed when the covers are folded, when the side wall of the cover overlaps that of the other cover, the curves are superfluous.

FIG. 4 shows an alternative embodiment of the container with abutment surfaces 35 or 36 arranged at an angle between them on the bottom surface 19 of the receptacle in the area of each bearing 15 or 16, by which arrangement the covers in their open position are supported on their internal surfaces. The aperture angle of the covers corresponds to the angle formed by the abutment surfaces. In this arrangement, the receptacle is positively adjusted in a position which corresponds to one half of the aperture or dihedral angle of the covers.

The container of the invention has the advantage that the articles contained therein, such as pencils, crayons, cigarettes (which can be in their original packing cases), or napkins or similar articles assume a positively angular position about midway between the fully opened covers and can thus easily and conveniently be handled. The position of the articles also is optically better visible when, for instance, crayons are arranged side by side in the receptacle in more than one row.

In accordance with a further improvement shown on FIG. 5, the receptacle is subdivided into several individual receptacles **13*a* which are flexibly connected and pivotable about their common pivot pin, while the bottom 19*a* of the central receptacle forms an angle of 90° with respect to the side walls 20*a* and 21*a*, thus being in vertical position in use. The bottom surfaces of the adjacent individual receptacles 13*a*** are sequentially more inclined. When the covers are unfolded the receptacles fan out positively around the vertical direction, as shown in the phantom lines. This arrangement further facilitates access to the articles held in the individual receptacles and makes them easier visible.

In a further embodiment shown in FIGS. 6 and 7, the receptacle **13*b* is divided in its longitudinal direction vertically into two half shells 26 and 27. Since cover 11*b* is supported by half shell 26 and cover 12*b* by half shell 27, a spacer 28 is provided for holding the container shells together. The spacer is provided, in correspondence with the bearing pins, with pivot pins 29 and 30 which correspond to recesses in half shells 26 and 27 as well as to bores in covers 11*b* and 12*b***.

This improvement presents the advantage that half shells 26 or 27 at the open position of the container can be unfolded into the cover plane. A container thus constructed is particularly suitable for holding paints which may be placed in individual compartments 31 provided in each half shell 26 or 27.

Figure 8:
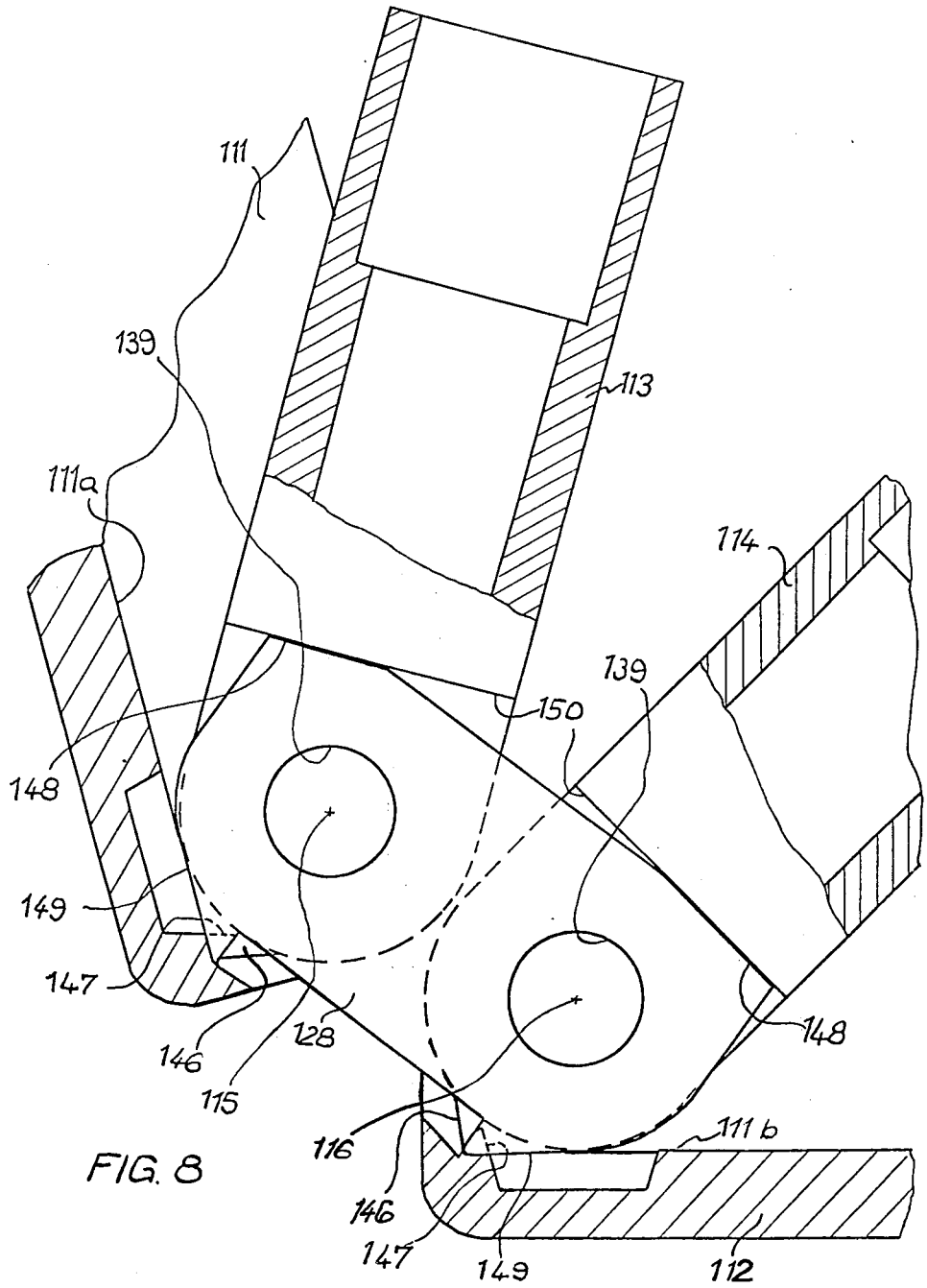
FIG. 8 is a cross sectional view of the joint arrangement between the covers and the receptacles of the container in partial presentation of a further improvement.

The container shown in FIG. 8 has two flat, boxlike covers 111 and 112 of the same shape and size, and two receptacles 113 and 114. It is particularly suitable for holding pencils and crayons, erasers and similar utensils.

Covers 111 and 112 are supported by receptacle 113 and 114, respectively, associated with them so as to pivot about a bearing 115 or 116 of their own.

Figure 10:
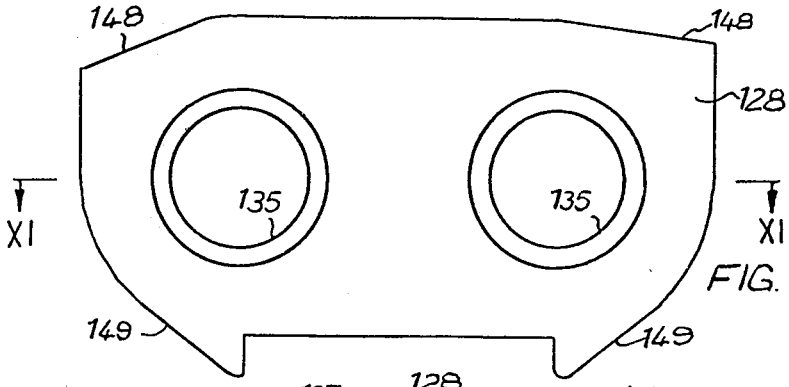
FIG. 10 is a detail view of the spacer of the joint arrangement of FIG. 8 in elevation.
Figure 11:
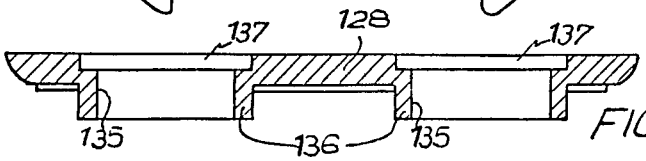
FIG. 11 shows the spacer of FIG. 10 in section along lines XI—XI of FIG. 10.

The covers as well as the receptacles are connected by means of a pair of spacers or links 128 which, when more than one receptacle is provided, forms an essential part of the joint. The spacer 128 is separately shown in FIGS. 10 and 11.

The spacer is provided with bores corresponding to the bearing pins 115 and 116, a flange 136 is provided on one side of spacer 128 concentrically with the bores 135, and a recess or counterbore 137 on the opposite side.

Figure 9:
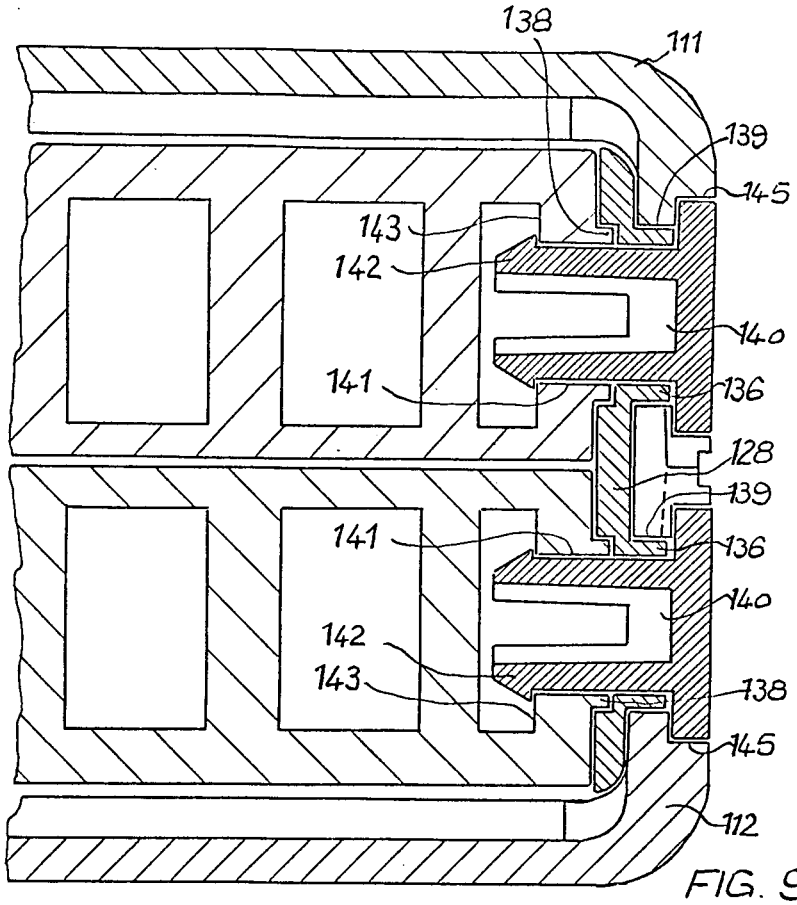
FIG. 9 shows the arrangement of FIG. 8 in section.

In the assembled state of the container shown in FIG. 9 a collar 138 projecting on receptacle 113 or 114 rests in recess 137. Flange 136 of spacer 128 projects into a bearing bore 139 of the covers 111 and 112.

An elastic expanding bushing 140 such as made from elastic plastic material, passes through the bearing bore 139 lined with the flange 136 and a bore 141 in the receptacles and projects with its studlike ends 142 behind a shoulder 143 provided in a cavity of the receptacles.

The cylindrical head of the expanding bushing 140 is positioned in a recess 145 of the cover 111 or 112 flush with the side wall concerned of the receptacle cover.

This provides a stable moving joint which permits also a convenient and quick assembly of the structural parts.

Projections 146 (FIG. 8) are provided on the receptacles 113 and 114, projections 147 are provided on the covers 111 and 112. These projections are for the positive erection of the individual receptacles 113 and 114 to their required position of use relative to the unfolded covers 111 or 112. In this position, each projection 146 abuts an opposed projection 147. Furthermore, support surfaces 148 and abutment surfaces 149 are provided on spacer 128, steps 150 on receptacles 113 and 114 are assigned to support surfaces 148, while abutment surfaces 149 cooperate with the internal surfaces 111*a* or 111*b* of the covers 111 or 112.

The mode of operation is the following: when the upper cover 111 of a closed container is unfolded, this cover 111 pivots about bearing 115 into its open position. Upon movement to this position its projection 147 abuts against projection 146 of the upper receptacle 113 and carries the latter along. Thus the receptacle 113 is positively erected. In the erection of the receptacle 113, step 150 thereof comes to rest on the support surface 148 of the spacer 128 and in turn carries along the spacer 128. The latter rotates about the bearing 116 until its support surface 148 abuts against the step 150 of the lower receptacle 114, and then also the receptacle 114 is positively pivoted about the bearing 116 into its position of use as shown at FIG. 8.

For this opening process it does not matter which of the covers represents the lower cover, since projection 146 as well as the coordinated projection 147 are provided on the receptacle 113 and cover 111 as well as on the receptacle 114 and on cover 112. In this manner the receptacle which happens to be the upper one is positively erected by its cover, and the receptacle which happens to be the upper one is positively erected by its cover and the receptacle which happens to be the lower one is carried along by means of spacer 128.

The angular position of the covers depends on the chosen angular position of the abutment surfaces 149 of spacer 128 with respect to each other. The angular position of the receptacles in their position of use depends on the arrangement of projections 146 and projections 147 and can be chosen accordingly.

When folded, covers 111 and 112 as well as receptacles 113 and 114 are parallel, whereas spacer 128 is positioned about vertically to the receptacles and covers.

Figure 12:
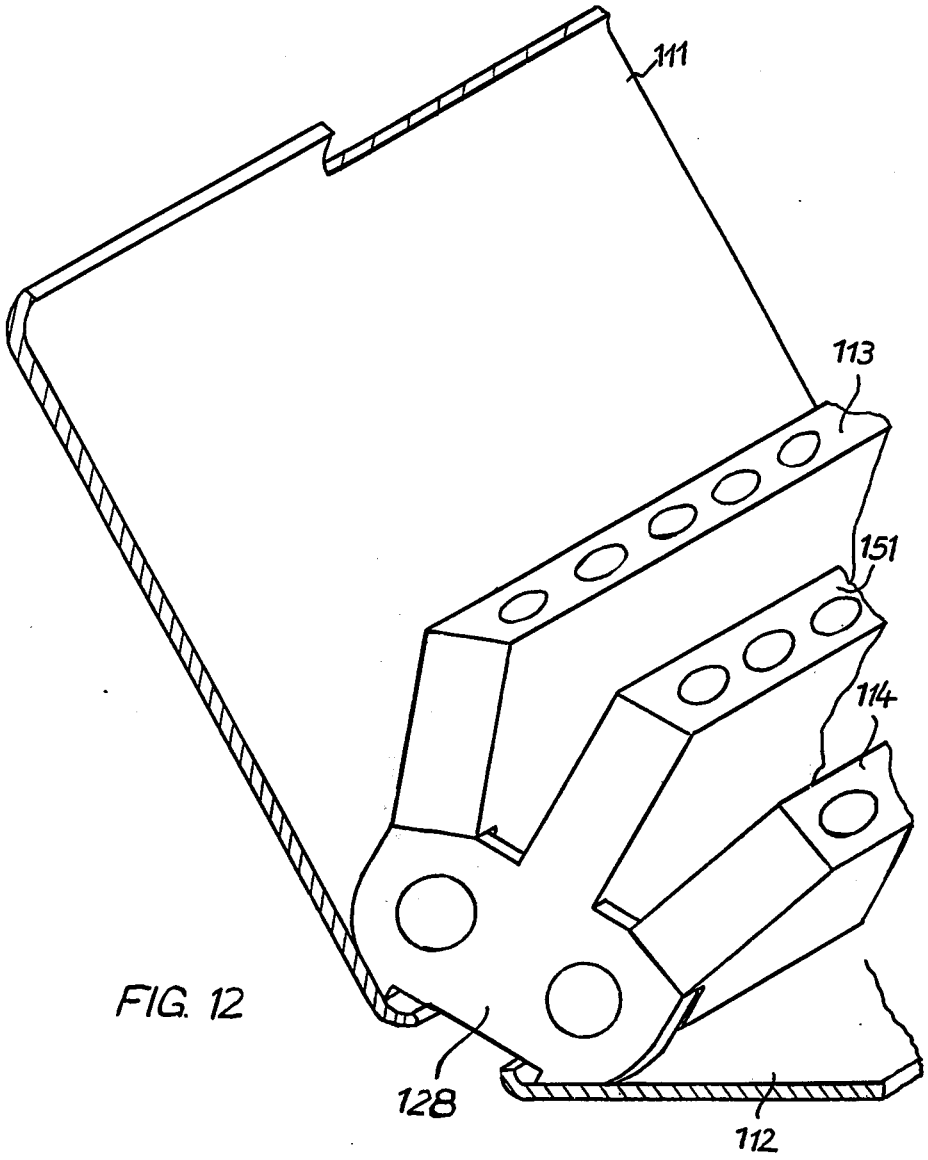
FIG. 12 is a perspective view of a container with three receptacles in a partly open state, of a further improvement.

FIG. 12 illustrates an additional improvement involving three receptacles. The third receptacle 151 is mounted between receptacles 113 and 114 and forms a single-piece structural part with the spacers 128 on both sides. Except for the greater width of spacer 128, this structural part is shaped in exactly the same way as already described on FIGS. 10 and 11. The movements involved during the opening of the container occur also in the same manner as shown in FIGS. 8 to 11.

In the folded state, the three receptacles are also superposed and parallel to covers 111 and 112. In the open state the third receptacle 151 rests in the angle bisector between the two covers 111 and 112. The position of use of the receptacles 113 and 114 is determined by suitable arrangement of projections 146, projections 147, and support surfaces 148.

I claim:

1. In a container for small elongated articles, a generally parallelepipedal box-like receptacle having an open top, end walls, a planar bottom, and side walls upstanding from and merging into said bottom in surfaces each arcuately curved about respective first and second laterally-spaced pivot axes, first and second substantially identical covers each including a side wall and first and second end edges upstanding therefrom, and mounting means mounting said covers on said receptacle along said spaced axes, for pivotal movement about respective ones of said axes, from a first position wherein the side walls of said covers are essentially coplanar, to a second position wherein the side walls of said covers are disposed in generally parallel spaced apart planes and enclose said receptacle, the side walls of each said cover, when in said second position, extending downwardly beyond their respective pivot axes to terminate in a straight edge engaging said planar bottom and camming said receptacle to erect position, by and in response to pivoting of said covers from their second to their first position; said pivoting means including a bearing for each cover; each said pivoting means being equally distant from the bottom surface and the side surface of the receptacle; the internal surface of each cover in the folded state of the container abutting against the side surface of the receptacle associated with its internal surface.

2. A container as claimed in claim 1, said radial distance of the pivoting axis of one cover from said bottom as well as from the side surface of the receptacle, being different from the corresponding distance of the other cover.

3. A container as claimed in claim 1, the subtended distance between said axes measured parallel to said bottom being equal at least to the sum of said two distances.

4. A container as claimed in claim 1, said at least one receptacle comprising:

a plurality of individual receptacles and means to erect them at the open position of the covers to an angular position which corresponds to an equiangular subdivision of the entire aperture angle of the covers.

5. In a container for small elongated articles, a generally parallelepipedal box-like receptacle having an open top, end walls, a planar bottom, and side walls upstanding from and merging into said bottom in surfaces each arcuately curved about respective first and second laterally-spaced pivot axes, first and second substantially identical covers each including a side wall and first and second end edges upstanding therefrom, and mounting means mounting said covers on said receptacle along said spaced axes, for pivotal movement about respective ones of said axes, from a first position wherein the side walls of said walls of said covers are essentially coplanar, to a second position wherein the side walls of said covers are disposed in generally parallel spaced apart planes and enclose said receptacle, the side walls of each said cover, when in said second position, extending downwardly beyond their respective pivot axes to terminate in a straight edge engaging said planar bottom and camming said receptacle to erect position, by and in response to pivoting of said covers from their second to their first position; the pivoting means further comprising:

pivot pins on the receptacle, and bores on the covers; said pivot pins and said bores together forming the cover bearings of the receptacle.

6. In a container for small elongated articles, a generally parallelepipedal box-like receptacle having an open top, end walls, a planar bottom, and side walls upstanding from and merging into said bottom in surfaces each arcuately curved about respective first and second laterally-spaced pivot axes, first and second substantially identical covers each including a side wall and first and second end edges upstanding therefrom, and mounting means mounting said covers on said receptacle along said spaced axes, for pivotal movement about respective ones of said axes, from a first position wherein the side walls of said covers are essentially coplanar, to a second position wherein the side walls of said covers are disposed in generally parallel spaced apart planes and enclose said receptacle, the side walls of each said cover, when in said second position, extending downwardly beyond their respective pivot axes to terminate in a straight edge engaging said planar bottom and camming said receptacle to erect position, by and in response to pivoting of said covers from their second to their first position; the corners of the covers which at the folded state face each other being provided with curvatures whose radii correspond to the distance of the center of the respective axes from the edge of its cover which in the folded state of the covers faces the edge of the other cover.

7. In a container for small elongated articles, a generally parallelepipedal box-like receptacle having an open top, end walls, a planar bottom, and side walls upstanding from and merging into said bottom in surfaces each arcuately curved about respective first and second laterally-spaced pivot axes, first and second substantially identical covers each including a side wall and first and second end edges upstanding therefrom, and mounting means mounting said covers on said receptacle along said spaced axes, for pivotal movement about respective ones of said axes, from a first position wherein the side walls of said covers are essentially coplanar, to a second position wherein the side walls of said covers are disposed in generally parallel spaced apart planes and enclose said receptacle, the side walls of each said cover, when in said second position, extending downwardly beyond their respective pivot axes to terminate in a straight edge engaging said planar bottom and camming said receptacle to erect position, by and in response to pivoting of said covers from their second to their first position; the longitudinal edge formed between a side surface and the bottom surface of a receptacle being provided with a curvature whose radius is positioned in the central axis of the respective pivoting means and corresponds to the distance of this central axis from the side surface or the bottom surface.

* * * * *